US007013764B2

(12) United States Patent
Leatherby

(10) Patent No.: US 7,013,764 B2
(45) Date of Patent: Mar. 21, 2006

(54) BASKET STRAINER EXTRACTOR DEVICE

(75) Inventor: Timothy S. Leatherby, Cerritos, CA (US)

(73) Assignee: Betty Jean Sutherland, Fullerton, CA (US)

( * ) Notice: Subject to any disclaimer, the term of this patent is extended or adjusted under 35 U.S.C. 154(b) by 54 days.

(21) Appl. No.: 10/877,116

(22) Filed: Jun. 25, 2004

(65) Prior Publication Data

US 2005/0050632 A1 Mar. 10, 2005

Related U.S. Application Data

(60) Provisional application No. 60/483,453, filed on Jun. 26, 2003.

(51) Int. Cl.
*B25B 13/48* (2006.01)

(52) U.S. Cl. ..... 81/176.15; 81/52

(58) Field of Classification Search ..... 81/176.15, 81/163–165, 52, 176.2, 120, 124.2, 180.1
See application file for complete search history.

(56) References Cited

U.S. PATENT DOCUMENTS

| | | | | |
|---|---|---|---|---|
| 6,058,813 | A * | 5/2000 | Bryant et al. | 81/176.15 |
| 6,360,636 | B1 | 3/2002 | Elftmann | 81/445 |
| 6,474,199 | B1 * | 11/2002 | Szasz | 81/52 |
| 6,564,679 | B1 * | 5/2003 | Llamas et al. | 81/176.15 |
| 6,715,385 | B1 * | 4/2004 | Wu | 81/176.15 |
| 6,895,838 | B1 * | 5/2005 | Stahnke | 81/176.15 |
| 2003/0041701 | A1 * | 3/2003 | Wang Wu | 81/176.15 |

* cited by examiner

*Primary Examiner*—Lee D. Wilson
(74) *Attorney, Agent, or Firm*—Sheldon & Mark

(57) ABSTRACT

A device for extracting a drain assembly from a basin, or for extracting joined pipes where there is not an adequate surface to attach a device to disengage the pipes. The device has a shaft with two or more insert pins, a top ring encasing the shaft, a bottom ring encasing the shaft, two or more dowel pins, and two or more wing segments.

12 Claims, 6 Drawing Sheets

BASKET STRAINER EXTRACTOR DEVICE

CROSS-REFERENCE TO RELATED APPLICATIONS

The present application claims the benefit of U.S. provisional patent application 60/483,453, titled "Basket Strainer Extractor Device," filed Jun. 26, 2003; the contents of which are incorporated in this disclosure by reference in their entirety.

BACKGROUND

Water basins, such as sinks and bath tubs typically include a basin and a drain opening formed at the lower portion of the basin. The drain opening connects the basin to disposal lines. The basin can include a drain assembly that includes a basket strainer and an integrally attached drain flange. The basket strainer provides a barrier to prevent items such as food, hair, utensils, brushes, sponges, and other items typically found around kitchens and bathrooms from entering and obstructing the disposal lines. The drain flange has a ring that rests on top of the drain opening and is nearly flush with the bottom of the basin. The drain assembly is semi-permanently secured to the drain opening by application of an adhesive such as plumbers putty to the underside of the drain flange.

Occasionally, the basket strainer and attached drain flange must be removed from the basin for replacement, refurbishing, or for maintenance purposes. A drain assembly that is installed within a drain opening of a basin is nearly flush with the basin. Thus, there is no convenient means of attaching a wrench to the top of the drain assembly for removal. Additionally, since the drain flange is semi-permanently attached to the basin with adhesive, and corrosion can further bind the drain assembly to the drain opening, removal of the drain assembly is further complicated. Often, drain assemblies have to be forcibly removed by cutting the drain assembly away from the basin or physically forcing the drain assembly from the basin by use of a drain key. This can result in damage to the basin and destruction of the drain assembly.

Therefore, it would be desirable to provide a device that allows a drain assembly to be extracted from the top side of a basin, without the application of vertical force from the underside.

Also, pipes joined to other pipes, such as with a threaded nipple configuration, can be difficult to remove if there is not an adequate surface to attach a device, such as a wrench to unscrew the pipes. This can occur when the pipe has been sheared or cut too close to the threads.

Tools for removing drain basket strainers are known, such as the device described in U.S. Pat. No. 6,360,636. However, such devices suffer from the disadvantages that they are not readily expandable to accommodate a wide range of drain sizes, require different feet for different drain baskets, and/or require multiple wrenches to operate.

Therefore, it would also be desirable to provide a device that can be adapted to a variety of drain assembly and pipe configurations, thereby providing a convenient means for extraction of drain assemblies and pipes of various shapes and sizes.

SUMMARY

According to the present invention, there is provided a device for extracting a drain assembly from a basin, or The device comprises a shaft having two or more insert pins, a top ring encasing the shaft, a bottom ring encasing the shaft, two or more dowel pins, and two or more wing segments. In one embodiment, the wing segments have serrations for engaging the drain assembly. Each wing segment is positioned between the top ring and the bottom ring and is rotationally connected to the top ring and the bottom ring by a dowel pin. Each wing segment can expand from a first retracted position to a second extended position by rotation of the shaft and insert pins relative to the top and bottom rings. In one preferred embodiment, the shaft has a notch and more preferably, the notch is sized to fit a socket drive. In another preferred embodiment, the bottom ring has two or more tip portions. In another preferred embodiment, the shaft is a steel extension shank, and more preferably, the steel extension shank is formed from an impact or hardened steel. In another preferred embodiment, one or more of the top ring, the bottom ring, and the wing segments are fabricated from a powdered steel alloy. In another embodiment according to the present invention, there is provided a method of removing a drain assembly from a basin. In one embodiment, the method comprises providing a device having a shaft with two or more insert pins, a top ring and a bottom ring encasing the shaft, two or more dowel pins, and two or more opposing wing segments, where the wing segments are rotationally connected to the top ring and the bottom ring by the dowel pins. The device is inserted into the drain assembly in a first retracted position. Then, the shaft of the device is connected to a rotation tool such as a wrench or a socket drive. The tool is rotated such that the shaft and insert pins are rotated around a vertical axis of the device. The rotation of the shaft and insert pins moves the wing segments of the device to a second extended position. In the second extended position, the wing segments of the device engage the drain assembly and further rotation of the shaft and insert pins around the vertical axis of the device will disengage the drain assembly from the basin and the drain assembly can be removed. The shaft and the insert pins can be rotated in an opposite direction around the vertical axis of the shaft to move the wing segments back to the first retracted position of the device to remove the device from the drain assembly. In a preferred embodiment, the bottom ring of the device has at least two tip portions and the tip portions of the bottom ring are positioned between cross bars of the drain assembly, which provides leverage for rotation of the shaft.

FIGURES

These and other features, aspects and advantages of the present invention will become better understood from the following description, appended claims, and accompanying figures where:

FIG. 1 is a partial cut away top perspective view of a basket strainer extraction device, shown in an extended position, appendant within a basin and drain assembly;

FIG. 2A a side perspective view of one embodiment of a basket strainer extraction device, shown in an extended configuration;

DESCRIPTION

Figure 1:
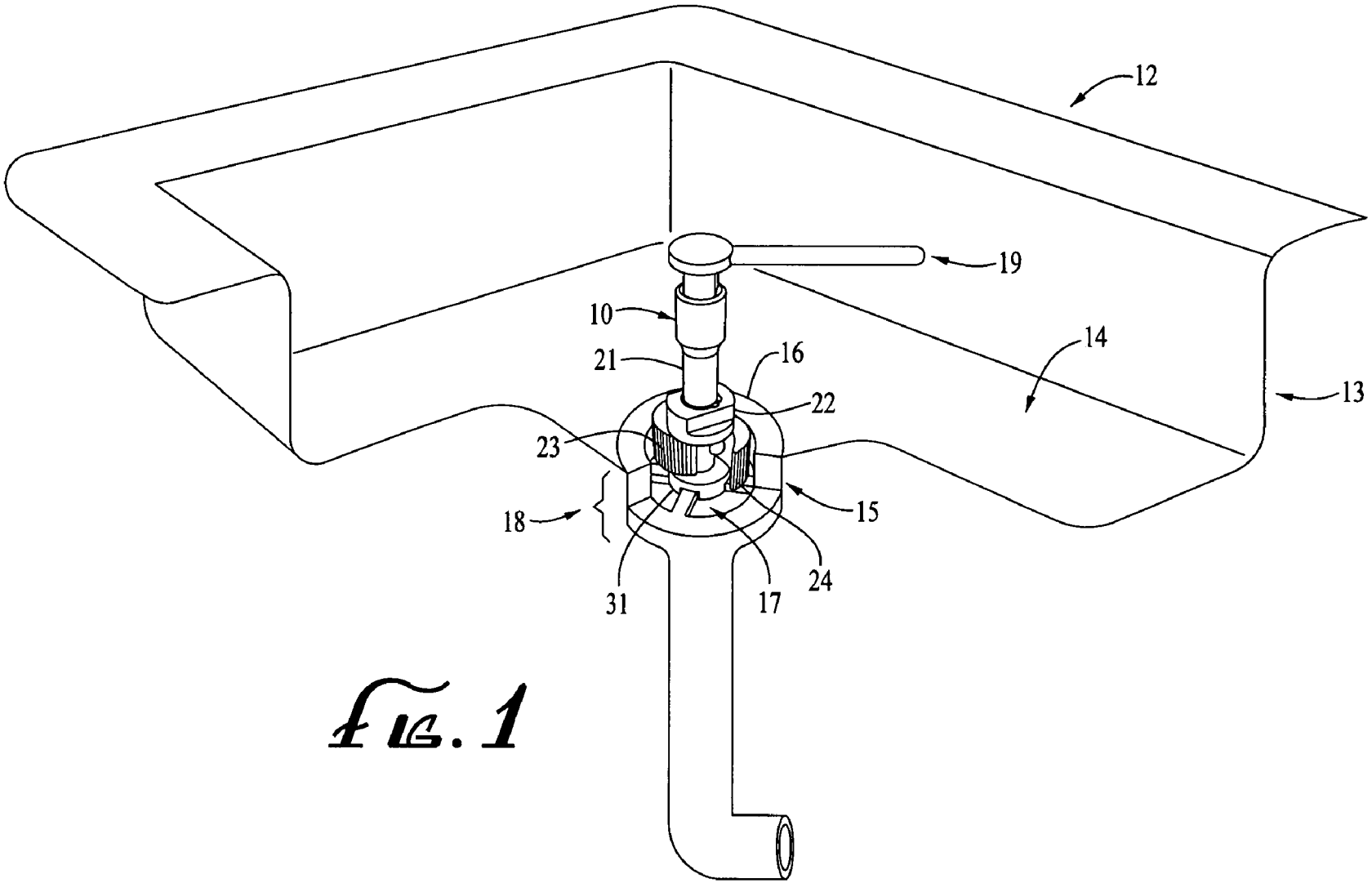

According to the present invention, there is provided a device for extracting a drain assembly from a basin. Drain assemblies and pipes of varying sizes and shapes can be extracted from drain openings of various shapes and sizes with one device according to the invention. In one embodiment of the present invention, there is provided a method for extracting a drain assembly from a basin. In another embodiment of the present invention, there is provided a device according to the present invention that can be used with the methods of the present invention for extracting a drain assembly from a basin.

Reference will now be made in detail to the description of the invention as illustrated in the drawings with like numerals indicating like parts throughout the several views.

As used in this disclosure, the term "comprise" and variations of the term, such as "comprising" and "comprises," are not intended to exclude other additives, components, integers or steps.

All dimensions specified in this disclosure are by way of example only and are not intended to be limiting. Further, the proportions shown in these Figures are not necessarily to scale. As will be understood by those with skill in the art with reference to this disclosure, the actual dimensions of any device or part of a device disclosed in this disclosure will be determined by intended use.

Referring now to FIG. 1, there is shown a partial cut away top perspective view of a basket strainer extraction device 10. In one embodiment of the present invention, as shown in FIG. 1, the device 10 is used for extracting a drain assembly 18 from a basin 12. However, the device of the present invention can be used for other extracting purposes, such as extracting pipes joined with a threaded nipple configuration, as will be understood by those of skill in the art with reference to this disclosure.

Figure 2A:
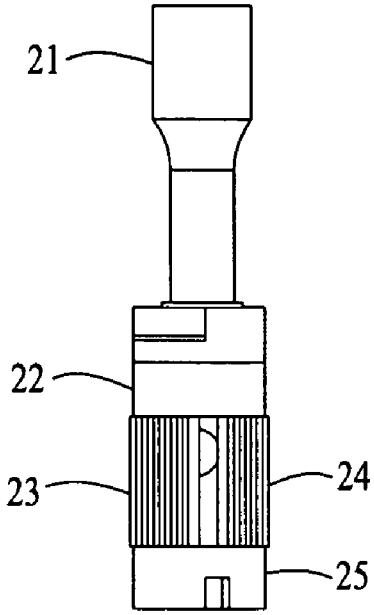
FIG. 2B is a bottom side perspective view of the basket strainer extraction device shown in FIG. 2A, in a retracted configuration.
FIG. 2C is a partial cut away side perspective view of the embodiment of the basket strainer extraction device shown in FIG. 2A, in a closed configuration.
Figure 2B:
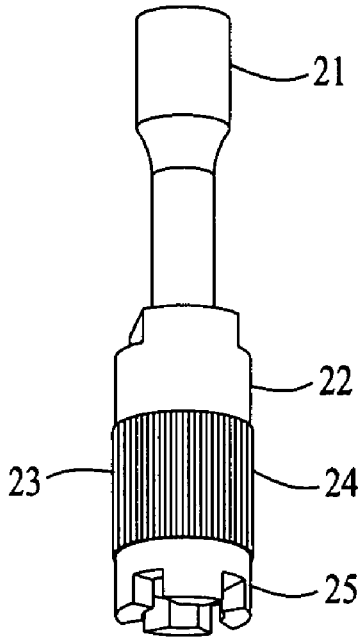
Figure 2C:
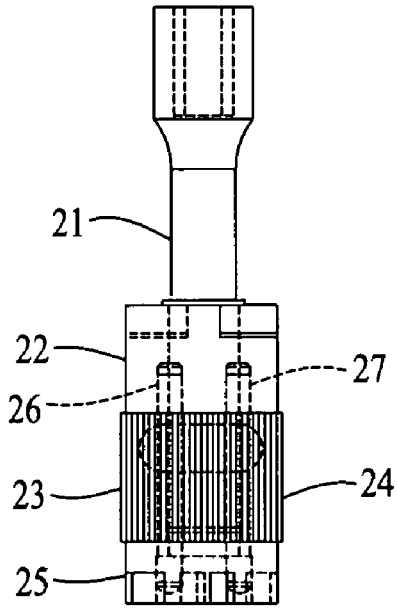

Referring now to FIGS. 2A and 2B, there is shown a side perspective view and a bottom side perspective view, respectively of the basket strainer extractor device 10. FIG. 2A shows the device in an extended, or open configuration. FIG. 2B shows the device in a retracted, or closed configuration. In one preferred embodiment of the invention, as shown in FIGS. 2A and 2B, the device 10 comprises a shaft 21 that is encased by top ring 22 and bottom ring 25. The opposing wing segment 23 and 24 are positioned between the top ring 22 and the bottom ring 25. As shown in FIG. 2C, a partial cut away side perspective view of the device shown in FIGS. 2A and 2B, the opposing wing segment 23 and 24 are rotationally connected to the top ring 22 and the bottom ring 25 by dowel pins 26 and 27.

The device 10 can be sized to fit into various drain assemblies, which can be from about 1 inch to 2 inches in diameter. However, the device can also be configured to fit into smaller sized pipes, such as a ½ inch diameter pipe, and also can be configured to fit into larger sized pipes, such as a 3 inch diameter pipe.

The device 10, with the opposing wing segment 23 and 24, is configured such that the opposing wing segment 23 and 24 can be opened to varying degrees depending on the inner diameter of the drain or pipe assembly. In a preferred embodiment, the device is used to extract a drain basket assembly, and the opposing wing segment 23 and 24 can expand from an outer diameter of about 1.3 inches in the retracted position to an outer diameter of about 2.1 inches in the extended position, which is also the inner diameter of a typical drain assembly. More preferably, the opposing wing segment 23 and 24 can expand from an outer diameter of about 1.3 inches to about 1.4 inches in the retracted position to an outer diameter of about 1.9 to about 2.1 inches in the extended position. However, other outer diameters of the opposing wing segment 23 and 24, in both the retracted and extended positions, can be used to extract drain assemblies and pipes of other inner diameters as will be understood by those of skill in the art with reference to this disclosure. In a more preferred embodiment, the length and arc of the opposing wing segment 23 and 24 is such that when the opposing wing segment 23 and 24 are fully closed, as shown in FIG. 2B, the opposing wing segments do not tightly close, which prevents accidental finger injury. However, other lengths and arcs of the opposing wing segment 23 and 24 can also be used, as will be understood by those of skill in the art with reference to this disclosure.

Referring again to FIGS. 2A and 2B, shaft 21, top ring 22, bottom ring 25, and the opposing wing segment 23 and 24 can comprise a conventional metal, such as steel, and can be formed by machining or other suitable methods for shaping metals, such as powdered steel casting, as will be understood by those of skill in the art with reference to this disclosure.

In another preferred embodiment of the invention, shaft 21 is machined from a preformed steel extension shank. Preferred extension shanks include NAPA™ and Craftsman™ impact and hardened shanks. However, other extension shanks can be used in the present invention as will be understood by those of skill in the art with reference to this disclosure.

In another preferred embodiment of the invention, the bottom ring 25 and the top ring 22 are cast from powdered steel. In a more preferred embodiment, the powdered steel used for casting the bottom ring 25 and the top ring 22 comprises chromium (from about 16% minimum to about 18% maximum), nickel (from about 10% minimum to about 14% maximum), manganese (from about 0% minimum to about 2% maximum), silicon (from about 0% minimum to about 1% maximum), sulphur (from about 0% minimum to about 0.03% maximum), carbon (from about 0% minimum to about 0.03% maximum), phosphorous (from about 0% minimum to about 0.045% maximum), molybdenum (from about 0% minimum to about 3% maximum), and nitrogen (from about 0% minimum to about 0.03% maximum) with a balance of iron. In a most preferred embodiment, the powdered steel used for casting the bottom ring 25 and the top ring 22 is stainless steel No. SS-316L, obtained from Metal Powder Products Company, Anaheim, Calif., US. However, other compositions of powdered steel and other types of metals can be used in the present invention as will be understood by those of skill in the art with reference to this disclosure.

In a preferred but not required embodiment of the present invention, the opposing wing segment 23 and 24 are cast from powdered steel. In a more preferred embodiment, the powdered steel used for casting the opposing wing segment 23 and 24 comprises chromium (from about 11.5% minimum to about 13.5% maximum), manganese (from about 0% minimum to about 1% maximum), silicon (from about 0% minimum to about 1% maximum), sulphur (from about 0% minimum to about 0.03% maximum), carbon (from about 0% minimum about 0.25% maximum), phosphorous (from about 0% minimum to about 0.04% maximum), and nitrogen (from about 0.2% minimum to about 0.6% maximum) with a balance of iron, impregnated with copper, and heat treated. In a most preferred embodiment, the powdered steel used for casting the opposing wing segment 23 and 24 is stainless steel No. SS-410, obtained from Metal Powder Products Company, Anaheim, Calif., US. However, other compositions of powdered steel and other types of metals can be used in the present invention, as will be understood by those of skill in the art with reference to this disclosure.

Figure 3A:
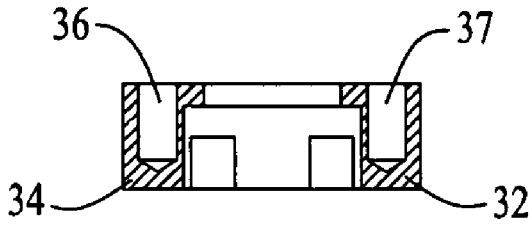
FIG. 3A is a partial cut away side perspective view of one embodiment of the bottom ring of the basket strainer extraction device.
Figure 3B:
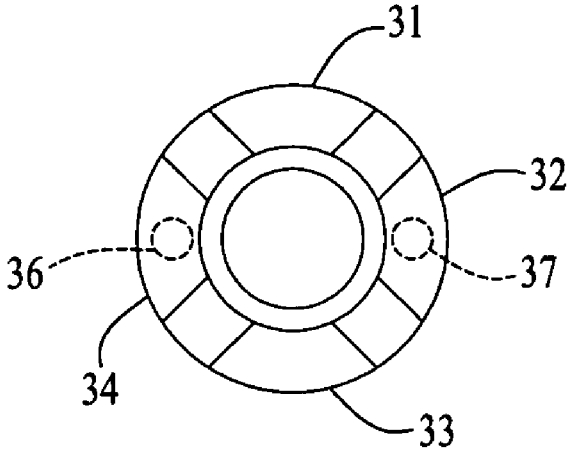
FIG. 3B is a bottom perspective view of the bottom ring of the basket strainer extraction device shown in FIG. 3A.
Figure 3C:
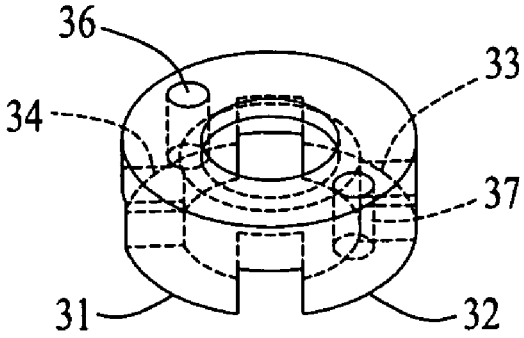
FIG. 3C is a partial cut away top side perspective view of the bottom ring of the basket strainer extraction device shown in FIG. 3A.

Referring now to FIGS. 3A, 3B, and 3C, there are shown a partial cut away side perspective view, a bottom perspective view, and a partial cut away top side perspective view, respectively, of the bottom ring 25 of the device 10. As shown in FIGS. 3A, 3B, and 3C, the bottom ring 25 is preferably notched with tip portions 31, 32, 33, and 34. As further shown in FIGS. 3A, 3B, and 3C, the bottom ring 25 contains the dowel pin hole 36 and 37. Preferably, the outer diameter of the bottom ring 25 is about 1.4 inches in diameter, which is sized to fit within a standard 1.5 inch drain basket assembly, and the tip portions 31, 32, 33, and 34 are sized such that the notches between the tip portions have about a 0.3 inch diameter. As shown in FIG. 1 and FIG. 2B, and the tip portions 31, 32, 33, and 34 are preferably sized to fit between the cross bars of the basket strainer 17 and the notches between the tip portions fit over the cross bars of the basket strainer 17.

Figure 4A:
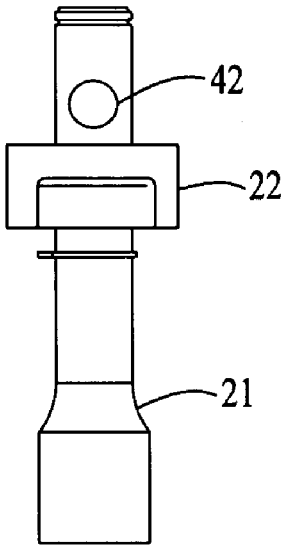
FIG. 4A is a side perspective view of the shaft and top ring of one embodiment of the basket strainer extraction device.
Figure 4B:
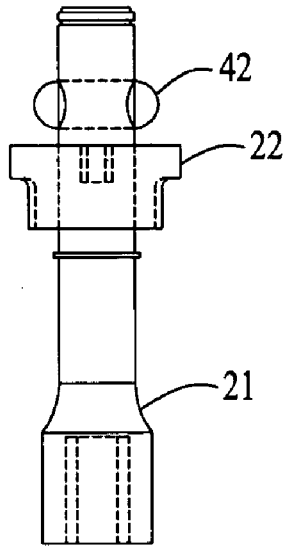
FIG. 4B is a partial cut away side perspective view of the shaft and top ring of the basket strainer extraction device shown in FIG. 4A.
Figure 4C:
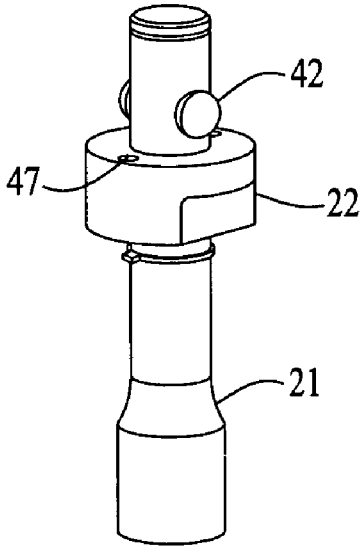
FIG. 4C is a top side perspective view of the shaft and top ring of the basket strainer extraction device shown in FIG. 4A.
Figure 4D:
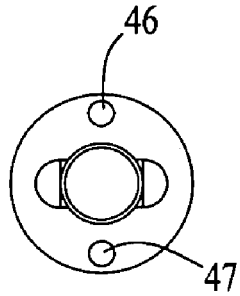
FIG. 4D is a bottom perspective view of shaft and top ring of the basket strainer extraction device shown in FIG. 4A.

Referring now to FIGS. 4A and 4B, there is shown a side perspective view and a partial cut away side perspective view, respectively, of the shaft 21 and top ring 22 of the device 10. As shown in FIGS. 4A and 4B, the top ring 22 encases the shaft 21. FIGS. 4A and 4B also show the insert pin 42, extending from the shaft 21. FIGS. 4C and 4D show a top side perspective view and a bottom perspective view, respectively, of the shaft 21 and top ring 22 shown in FIGS. 4A and 4B. As shown in FIGS. 4A and 4B, the top ring 22 contains the dowel pin holes 46 and 47.

Figure 5A:
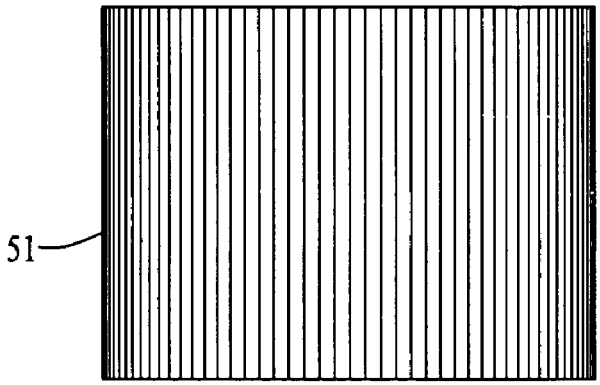
FIG. 5A is a side perspective view of one embodiment of a wing segment of the basket strainer extraction device.
Figure 5B:
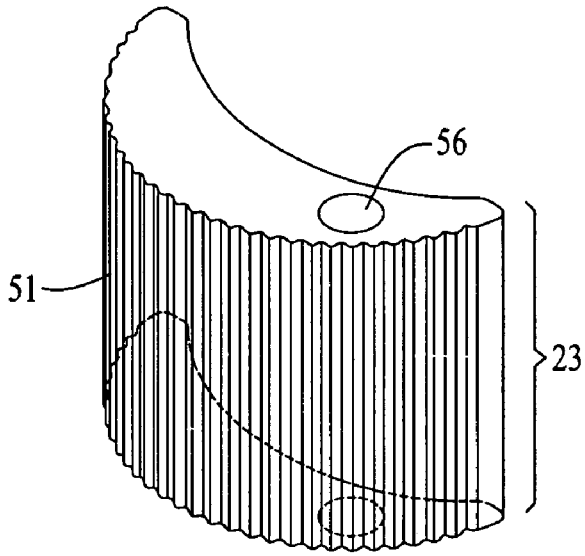
FIG. 5B is a top side perspective view of the wing segment of the basket strainer extraction device shown in FIG. 5A.
Figure 5C:
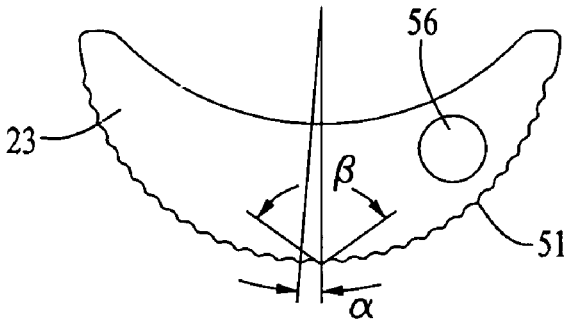
FIG. 5C is a top perspective view of the wing segment of the basket strainer extraction device shown in FIG. 5A.

Referring now to FIGS. 5A, 5B, and 5C, there is shown a side perspective view, a top side perspective view, and a top perspective view, respectively, of the opposing wing segment 23 of the device 10. As shown in FIGS. 5A, 5B, and 5C, in a preferred but not required embodiment, the opposing wing segment 23 and 24 contain serrations 51, which are about 0.01 inches in depth, and the dowel pin hole 56 and 57. Preferably, as shown in FIG. 5C, the angles $\alpha$ and $\beta$ of the wing segments 23 and 24 are 5° and 120°, respectively.

Figure 6A:
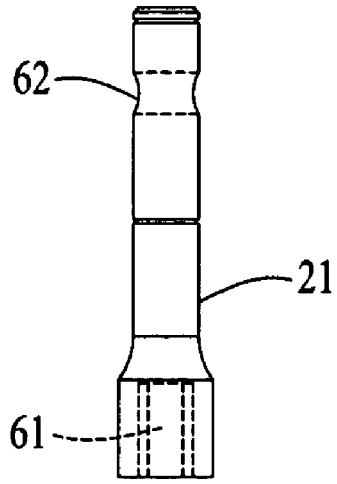
FIG. 6A is a partial cut away side perspective view of a first side of one embodiment of the shaft of the basket strainer extraction device.
Figure 6B:
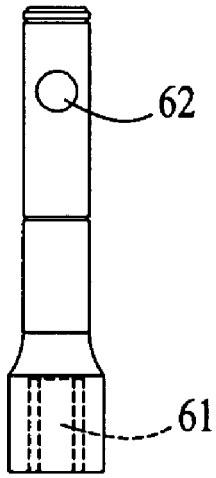
FIG. 6B is partial cut away side perspective view of a second side of the shaft of the basket strainer extraction device shown in FIG. 6A.
Figure 6C:
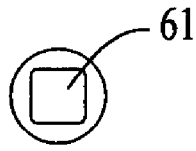
FIG. 6C is a top perspective view of one embodiment of a shaft of the basket strainer extraction device.

Referring now to FIGS. 6A and 6B, there is shown a partial cut away side perspective view of a first side, and a partial cut away side perspective view of a second side, respectively, of the shaft 21 of the device 10. As shown in FIGS. 6A and 6B, the shaft 21 contains the insert pin hole 62. Referring now to FIG. 6C, there is shown a top perspective view of the shaft 21 of the device 10. FIG. 6C shows an embodiment of the invention where the shaft 21 contains a notch 61. The notch 61 can be sized to fit a ½ inch socket drive or impact wrench. Alternately, the shaft 21 can have a lug extending from the shaft to receive a wrench or other tool to manipulate the device.

In another embodiment, the present invention is a method of using a basket strainer extractor device for extracting a drain assembly from a basin. Now referring to FIGS. 1, 2C, 3B, 3C, and 5A, one embodiment of the method of the invention comprises providing a strainer extractor device 10. The device 10 comprises a shaft 21, a top ring 22, a bottom ring 25, having tip portions 31, 32, 33, and 34, opposing wing segment 23 and 24, that are positioned between the top ring 22 and the bottom ring 25, and rotationally connected to the top ring 22 and the bottom ring 25 by the dowel pins 26 and 27. The device 10 is inserted into a basin 12 in a first retracted position. The basin has interior side walls 13, an interior bottom 14, a drain opening 15, a drain flange 16, and basket strainer 17. The interior bottom 14 cooperates with drain flange 16 and basket strainer 17 to form drain assembly 18. The tip portions 31, 32, 33, and 34 of the device 10 are positioned within the basket strainer 17 such that the tip portions engage the basket strainer 17. Then, a tool, such as a socket drive or a wrench is connected to the shaft 21 of the device 10. Then, the tool is used to rotate the shaft 21 around the vertical axis of the shaft 21. The movement of the shaft 21 and corresponding movement of the insert pin 42 moves the opposing wing segment 23 and 24 to a second extended position, as shown in FIG. 1. The bottom ring 25 remains in a fixed position relative to the shaft 21, thereby engaging the basket strainer 17 and providing leverage for rotation of the shaft 21. The shaft 21 is further rotated around the vertical axis of the shaft 21, thereby engaging the extended opposing wing segment 23 and 24, which include serrations 51, with the inner sides of the drain flange 16 and extracting the drain flange 16 and the basket strainer 17 from the drain hole 16. Rotating the shaft 21 and the insert pin 42 clockwise around the vertical axis of the shaft 21 moves the opposing wing segment 23 and 24 back to the first retracted position of the device. In a preferred, but not required embodiment of invention, a wrench 19, such as a torque wrench, is inserted into the shaft 21 and turned to rotate the shaft 21. However, the shaft 21 can be rotated by other means, such as with a drill assembly or hammer drive, as will be understood by those of skill in the art with reference to this disclosure.

Although the present invention has been discussed in considerable detail with reference to certain preferred embodiments, other embodiments are possible. Therefore, the scope of the appended claims should not be limited to the description of preferred embodiments contained in this disclosure.

What is claimed is:

1. A device for extracting a drain assembly from a basin comprising:

a shaft having two or more insert pins;

a top ring encasing the shaft;

a bottom ring encasing the shaft;

two or more dowel pins; and two or more wing segments having serrations for engaging the drain assembly, where each wing segment is positioned between the top ring and the bottom ring and rotationally connected to the top ring and the bottom ring by a dowel pin, and where each wing segment expands from a first retracted position to a second extended position by rotation of the shaft and insert pins relative to the top and bottom rings.

2. A device according to claim 1 wherein the shaft further comprises a notch.

3. A device according to claim 2 wherein the notch is sized to fit a socket drive.

4. A device according to claim 1 wherein the bottom ring further comprises two or more tip portions.

5. A device according to claim 1 wherein the shaft is a steel extension shank.

6. A device according to claim 1 wherein the steel extension shank is formed from an impact or hardened steel.

7. A device according to claim 1 wherein one or more of the top ring, the bottom ring, and a wing segment is fabricated from a powdered steel alloy.

8. A device according to claim 1 wherein the outer diameter of the device in the first retracted position is from about 1.3 inches to about 1.4 inches.

9. A device according to claim 1 wherein the outer diameter of the device in the second extended position is from about 1.9 inches to about 2.1 inches.

10. A method of removing a drain assembly from a basin comprising:

a) providing a device having a shaft with two or more insert pins, a top ring and a bottom ring encasing the shaft, two or more dowel pins, and two or more opposing wing segments, where the wing segments are rotationally connected to the top ring and the bottom ring by the dowel pins;

b) inserting the device into the drain assembly in a first retracted position;

c) connecting the shaft of the device to a rotation tool;

d) rotating the tool such that the shaft and insert pins are rotated around a vertical axis of the device, thereby moving the wing segments of the device to a second extended position;

f) engaging the wing segments in the second extended position with the drain assembly; and g) further rotating the shaft and insert pins around the vertical axis of the device to remove the drain assembly from the basin.

11. A method according to claim 10 further comprising rotating the shaft and the insert pins in an opposite direction around the vertical axis of the shaft to move the wing segments back to the first retracted position of the device.

12. A method according to claim 10 wherein the bottom ring of the device further comprises at least two tip portions and wherein the drain assembly has a set of cross bars and the tip portions of the bottom ring are positioned between the cross bars of the drain assembly.

* * * * *